United States Patent [19]

Manusch et al.

[11] Patent Number: 4,627,757

[45] Date of Patent: Dec. 9, 1986

[54] WRITING INSTRUMENT WITH SIGNALING CAP

[75] Inventors: Christoph Manusch, Hanover; Günter Scholz, Garbsen, both of Fed. Rep. of Germany

[73] Assignee: Pelikan Aktiengesellschaft, Hanover, Fed. Rep. of Germany

[21] Appl. No.: 691,456

[22] Filed: Jan. 14, 1985

[30] Foreign Application Priority Data

Jan. 19, 1984 [DE] Fed. Rep. of Germany ..... 3401739

[51] Int. Cl.[4] ..... B43K 9/00

[52] U.S. Cl. ..... 401/194; 401/192; 401/202; 401/213; 401/243; 401/247; 401/262; 401/269

[58] Field of Search ..... 401/192, 194, 202, 247, 401/243, 244, 245, 246, 269, 262, 213

[56] References Cited

U.S. PATENT DOCUMENTS

| | | | |
|---|---|---|---|
| 969,198 | 9/1910 | Sanford | 401/246 |
| 1,838,543 | 12/1931 | Goldstein | 401/244 X |
| 2,339,514 | 1/1944 | Ponath | 401/194 X |
| 2,396,866 | 3/1946 | Lytton | 401/244 |
| 2,453,491 | 11/1948 | Cardin | 401/244 |
| 2,808,670 | 10/1957 | Katz . | |
| 3,565,540 | 2/1971 | Andrews | 401/269 X |
| 3,802,788 | 4/1974 | Danjczek | 401/194 |

FOREIGN PATENT DOCUMENTS

| | | | |
|---|---|---|---|
| 263575 | 7/1968 | Austria . | |
| 668620 | 12/1938 | Fed. Rep. of Germany . | |
| 2138694 | 2/1973 | Fed. Rep. of Germany | 401/202 |
| 7421165 | 9/1974 | Fed. Rep. of Germany . | |
| 595461 | 12/1947 | United Kingdom | 401/247 |
| 619349 | 3/1949 | United Kingdom | 401/244 |
| 631195 | 10/1949 | United Kingdom | 401/244 |

*Primary Examiner*—Steven A. Bratlie

*Attorney, Agent, or Firm*—Karl F. Ross; Herbert Dubno

[57] ABSTRACT

An indicating cap for a writing instrument has an insert with a blind passage adapted to fit over the tip of e.g. a felt or fiber tip pen or marker and axially movable in a sleeve forming a cap between two limiting positions. One of these positions is defined by a spring detent shoulder against which a shoulder of the insert abuts when the cap is withdrawn from the writing implement. When the cap is thrust properly onto the writing implement the insert is pressed into its second position in which a pin of appropriate color is visible through an end of the sleeve where the projecting pin can be protected by a hood or basket.

13 Claims, 6 Drawing Figures

WRITING INSTRUMENT WITH SIGNALING CAP

FIELD OF THE INVENTION

Our present invention relates to a writing instrument with a signaling cap and, more particularly, to a removable cap for such instruments which is capable of indicating that the cap has been properly positioned on the instrument.

BACKGROUND OF THE INVENTION

For felt-tip, fiber-tip and other capillary writing instruments, generally pens and markers, it is desirable to provide a cap which is capable of indicating that the cap has been firmly and fully applied to the writing tip of the instrument and thus which can serve as an assurance that the tip will not dry out.

To this end it has been proposed to provide a cap internally with a longitudinally shiftable insert which is displaceable between two abutments, one position serving to indicate that the cap has been properly applied to the tip whereas the other represents the position in which the tip has been withdrawn from the cap.

A writing instrument having a shiftable insert is described in U.S. Pat. No. 2,808,670 in which the insert is a cylinder sleeve which is pressed into the first position by a compression spring received in the cap and becomes effective when the cap is withdrawn from the instrument.

The insert in this position projects from the cap and provides a view of a free surface which can be formed with an image.

Upon application of the cap to the instrument, the insert is shifted inwardly by an abutment surface on the tip of the writing implement. The compression spring is stressed and the image-carrying surface is obstructed by the cap. The fastening of the cap in place is effected via a screw thread which also takes up the prestressing force of the spring. The purpose of this cap is to provide an image or other visible character when the cap is removed from the writing implement, the image or character serving to inspire the writer. This system does not, therefore, provide a signal for the complete sealing engagement of the cap on the writing implement since the image is uncovered by the cap even before the tip has been fully sealed by the cap.

The protective cap for a fiber marker or writing implement (German Utility Model No. DE-GM 74 21 165) can be provided with a forward portion which lies upon the writing tip after application of the cap, and has a surface which is visible, transparent or the like to permit the writing color to be readily recognized, thereby eliminating any need for special coloration of the cap. The interior of the transparent portion of the cap can be easily covered with the writing color so that the actual position of the point or tip within the cap cannot be determined.

In this case, although a proper sealing signal might be given, frequently such a signal is not given and it is not possible to determine whether a cap has been properly seated upon the tip of the writing implement.

OBJECTS OF THE INVENTION

It is the principal object of the present invention to provide a writing instrument with a removable cap which is effective to allow the user to determine that the cap has been correctly mounted upon the tip of the writing instrument.

Another object of the invention is to provide an improved cap for a writing instrument which is capable of signaling the fact that the cap has been correctly and fully applied.

Yet another object of this invention is to provide a cap which also is capable of signaling the color of the ink of the writing instrument which is protected thereby.

SUMMARY OF THE INVENTION

These objects and others which wi11 become more readily apparent hereinafter are attained, in accordance with the present invention, in a writing instrument in which an insert has a blind bore frictionally engaging the tip of the writing instrument, the insert being held in the cap in a first position by a threshold force latching means, whose latching force is less than the friction force entraining movement of the insert when the cap is forced over the end of the instrument and which also is provided with means enabling the user to determine that the cap has sufficiently been seated on the tip. The cap of the invention, therefore, is particularly effective in protecting fiber tip pens or other writing or marking instruments against drying out.

According to a feature of the invention, therefore, the writing instrument comprises a writing implement having a writing tip and a cap removably mounted on this implement and including a sleeve adapted to be fitted over this tip, an insert movable in the sleeve and engageable with the tip to receive the same in a blind passage of the insert and protecting the tip against drying out, and a threshold latching means in the sleeve engageable with the insert for retaining it with a threshold force greater than the friction force of said insert against said tip in a first position within the sleeve until the insert is fully seated on the tip whereby the latching or threshold force then is exceeded and the insert is shifted in the sleeve to a second position. This friction should be sufficient to return the insert to its first position upon withdrawal of the sleeve from the insert.

In accordance with another feature of the invention, the cap preferably has a second threshold abutment in which the insert is held in a second position and whose threshold force by retraction of the cap from the tip is less than that generated by the friction between the tip and the insert.

This embodiment has the advantage that the cap and the insert are held together in the second position with the threshold force of the second latching means, thereby eliminating the need for a special positioning device for the cap relative to the writing implement.

Both threshold latches are advantageously formed as detents, i.e. spring loaded members engageable via notch or recess formations. An especially simple and convenient construction provides a locking ring in the cap as a sleeve or jacket which has axially extending tongues, the ring being formed with an annular shoulder which is braced upon the surrounding sleeve at an inwardly extending annular shoulder of the latter and is held in place by the cover. This provides a particularly convenient and effective way of holding the ring in place, the resilient tongues generating the retaining force for the detent or detents.

The tongues can have abutment surfaces at their ends which retain the insert in one or another extreme position although the abutment surfaces on the tongues can also serve to retain the insert in both extreme positions.

According to a feature of the invention the signal that the cap has been properly seated on the writing implement is afforded by providing the sleeve with an opening at an end through which a pin of the insert projects and thereby becomes fully visible when the insert is properly seated upon the cap.

The pin can be partly visible in its position in the cap in which the cap has been withdrawn from the writing implement so that the color of the pin, which can correspond to the color of the ink, can be readily discerned even in the position in which the cap has been withdrawn from the instrument.

The projecting pin can be protected, in turn, by a transparent cover or by a basket.

When the sleeve is opaque, the pin can only be viewed through the transparent hood or cover and thus appears to completely fill the hood or cover in one position signaling that the cover has been fully applied to the tip. In this case, the insert is fully protected within the sleeve as contrasted with the basket arrangement. At its open end, the insert is preferably provided with an outwardly flared end which can scrape along the inside of the sleeve to provide effective guiding of the insert and to prevent penetration of dirt or contaminants into the gap between the cap and the insert. Finally, the cap can have a lateral window which permits the insert to be visible in the second position.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
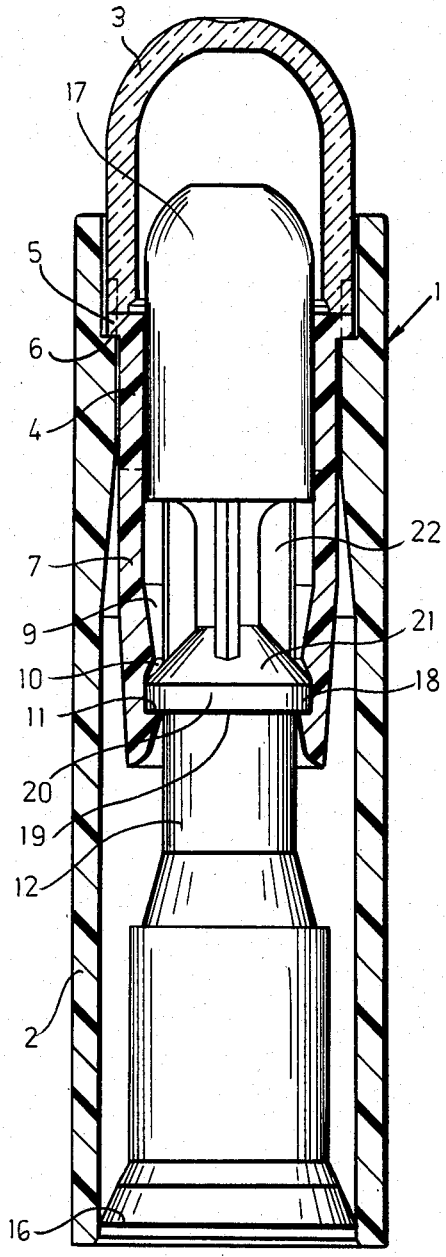
FIG. 1 is an axial section through a cap after it has been removed from the writing implement in accordance with a feature of the invention.
Figure 2:
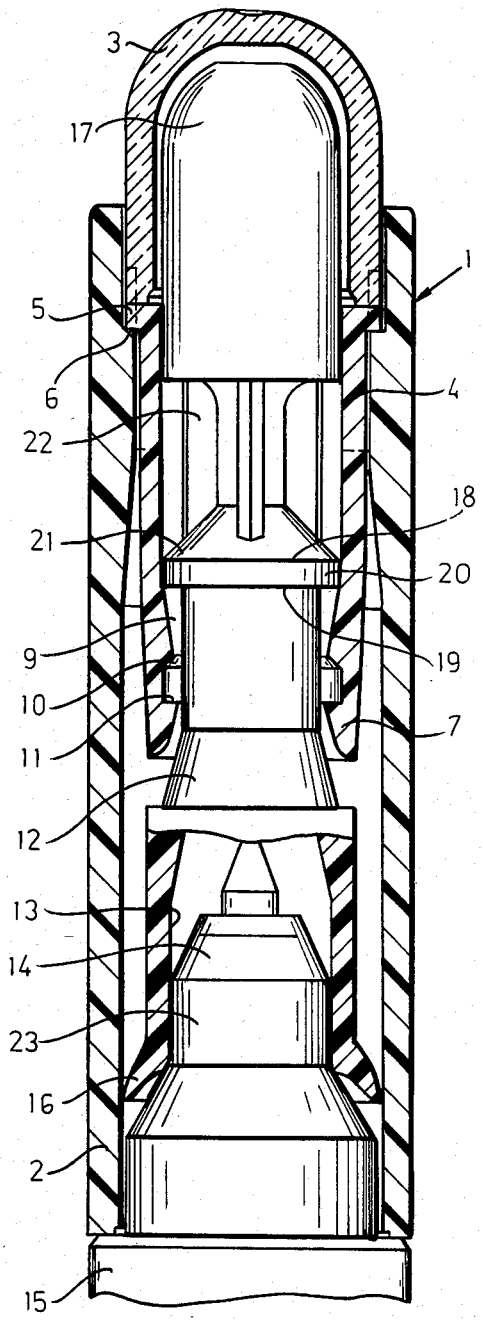
FIG. 2 is a view of the cap when the latter is fully mounted upon a writing implement.
Figure 3:
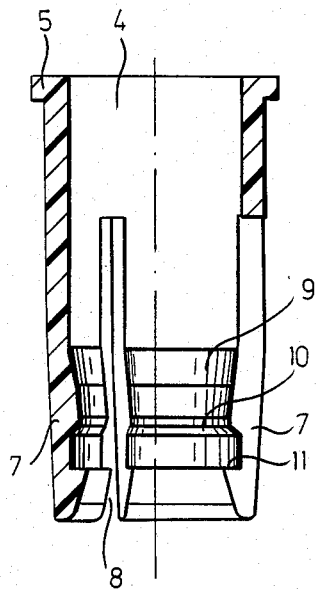
FIG. 3 is a longitudinal section through the latch ring of the embodiments of FIGS. 1 and 2.
Figure 4:
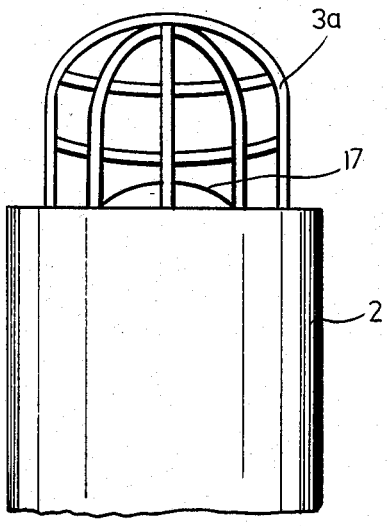
FIGS. 4 and 5 are elevational views of the basket and the hood embodiment of the invention.
Figure 5:
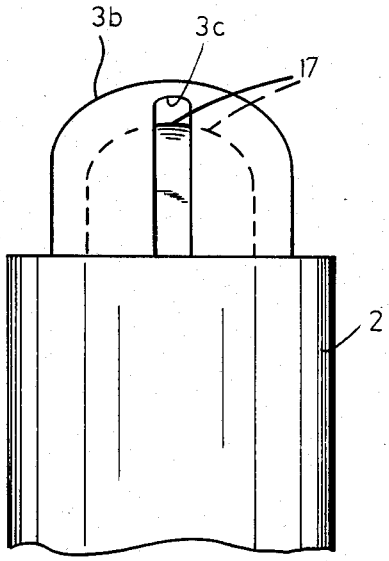

The cap 1 seen in FIGS. 1 and 2 comprises a substantially cylindrical sleeve 2, one end of which is closed by a transparent hood 3, by a grate or basket 3*a* (FIG. 4) or an opaque cover 3*b* provided with a slot 3*c* (FIG. 5) through which a pin 17 at the end of the insert 12 becomes visible.

Within the sleeve 2, we provide a latching ring 4 which is held by an annular shoulder 5 between an abutment shoulder 6 of the sleeve and the hood 3. The ring 4 has three identical angularly equispaced longitudinally extending spring tongues 7 which terminate substantially in the middle of the sleeve 2. The tongues 7 are separated by slits 8. On the inner surface of each tongue 7 planar inclined flanks 9 are provided opposite steep ramp surfaces 10 which are disposed on the flanks of the groove of each tongue opposite the abutment surfaces 11.

Insert 12, which is axially displaceable in the sleeve 2, has a length corresponding substantially to that of the sleeve. At its end opposite its closed end, the insert 12 is provided with a blind bore 13 adapted to receive the tip of the insert.

The insert 12 is formed with a scraper edge 16 which slidably engages the outer member. The outwardly flared scraper edge 16 rides against the inner wall of the sleeve 2 of the cap 1 and thus provides a guide for the latter.

The opposite end of the insert 12 is formed as the signal pin 17 which becomes fully visible and represents a display of the position of the insert. In the center of the unit the insert 12 has a frustoconical annular shoulder 18 with a steep surface 19, a cylinder surface 20 and a frustoconical surface 21.

Radial ribs 22 connect the conical surface 21 to the signal portion 17 and stiffen the constricted region in this zone of the insert 12.

Upon withdrawal of the cap 1 from the tip of the writing instrument 15, the insert 12 is drawn into its position shown in FIG. 1. In this case, the insert 12 has its shoulder surface 19 in engagement with the abutment 11. The spring tongues 7 bear upon the cylindrical surface 20 and the ramp surface 10 lies directly against the frustoconical surface 21 to form a threshold latch. The threshold is defined as the force which must be applied to the insert 12 in the cap 1 to advance it from the position shown in FIG. 1 to the position shown in FIG. 2.

When the cap is to be mounted on the writing instrument, the insert 12 with its blind bore 13 is fitted over the tip. The friction between the tip and the bore 13 is less than the force generated at the cylinder surface 20 so that the tip is fully received in the cap before further resistance of movement of the insert causes its shoulder 20 to spring fully out of the groove in the spring tongues 7.

The blind bore 13 and the closely fitting surface 23 generate a friction which is, however, smaller than that applied by the ramp surface 10 so that, upon removal of the cap, the insert will be held in place on the tip until the shoulder 20 springs into the recess of the spring arms and a more rigid connection between surfaces 11 and 19 is applied. Only then can the full force be applied so that the further movement of the cap draws the insert off the tip (FIG. 2). This, of course, prevents the tip from drying out.

The signal pin 17 can have a coloration matching that of the ink which is used. For example, the signal pin 17 can be red when the ink is red. Alternatively, the signal pin can be provided with a color giving the effect of an alert to improper closure and can be independent of the color of the ink contained in the instrument.

Figure 6:
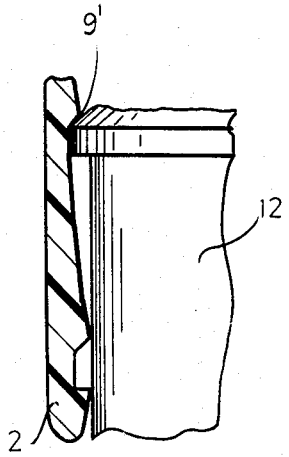
FIG. 6 is a detail section showing the cooperation of the spring elements with the insert.

FIG. 2 shows the signaling position of the device. In this position the cap 1 is held by a second latching means which has been provided with a latch as represented at 9' in FIG. 6 to form a well defined stop at which any further motion of the insert with respect to the cap is strictly limited. The insert 12 adheres with its blind bore 13 frictionally to the appropriate surface 23.

Since the threshold force generated by the ramp surface 9 is smaller than the friction force between the insert 12 and the writing tip 14, with removal of the cap the insert will jump return to its position shown in FIG. 1. Only in this manner can the full removal force be transferred to the insert to allow the insert to be withdrawn from the writing implement.

In the position shown in FIG. 1, the end only of the pin 17 is visible so that the color of the ink can be discerned although it is equally apparent that in this position it can also be determined that the cap is not fully seated on the tip.

The cap can be fabricated simply and the device has a minimum number of parts most of which can be injection molded at low cost from synthetic resin. The fluctuations in the friction force between the tip 14 and the blind bore are not detrimental to the functioning of the device.

We claim:

1. A writing instrument comprising:

an elongated writing implement having a writing tip; and a cap removably mounted on said implement and including:

a sleeve adapted to be fitted over said tip, an elongated insert movable in said sleeve and receiving at least a portion of said tip at one end of said insert in a blind passage of said insert to protect said tip against drying out, said insert engaging said tip with a friction force, threshold latching means in said sleeve engageable in said insert for retaining it with a threshold force greater than the friction force of said insert against said tip in a first position with said sleeve until said insert is fully seated on said tip whereby said threshold force is then exceeded and said insert is shifted in said sleeve to a second position, and said friction is sufficient to return said insert to said first position upon withdrawal of said sleeve from said instrument, said latching means including a latching ring fixed in said sleeve and formed with a plurality of axially extending inwardly biased spring tongues surrounding said insert and having surfaces of different inclinations engaging a shoulder formed on said insert and spaced from said end with said threshold force to retain said insert in said first position until said threshold force is exceeded, and a signal pin on said insert fully visible only in said second position of said insert at a free end of said sleeve remote from said end of said insert receiving said tip.

2. The writing instrument defined in claim 1 wherein said latching means is constructed and arranged to define for said insert a second threshold force less than the first mentioned threshold force and the friction of said tip exerted upon said insert.

3. The writing instrument defined in claim 2 wherein said tongues are additionally provided with abutments engageable with said insert in at least one of said positions and preventing movement of said insert relative to said sleeve beyond said one of said positions.

4. The writing instrument defined in claim 2 wherein said pin projects in said second position of said insert from an opening at said free end of said sleeve.

5. The writing instrument defined in claim 4, further comprising a basket protecting and enclosing the projecting pin at said free end.

6. The writing instrument defined in claim 4 wherein said sleeve is open and is provided with a transparent hood enclosing the projecting pin at said free end.

7. The writing instrument defined in claim 6 wherein said ring has an annular outwardly extending shoulder seated against an inwardly directed shoulder of said sleeve and held in place therein by said hood.

8. The writing instrument defined in claim 2 wherein said cap has a window opened laterally and through which said pin is visible in said second position.

9. The writing instrument defined in claim 2 wherein said shoulder of said insert is provided with an annular frustoconical formation.

10. The writing instrument defined in claim 9 wherein said pin is connected to said formation by a plurality of axially extending angularly spaced radial ribs.

11. The writing instrument defined in claim 10 wherein said pin has the same color as an ink dispensed by said tip.

12. The writing instrument defined in claim 11 wherein said implement is a fiber tip marker.

13. The writing instrument defined in claim 12 wherein said insert has an outwardly flared lip riding on the interior of said sleeve and forming a guide for said insert.

* * * * *